US010195721B2

(12) United States Patent
Marcon

(10) Patent No.: US 10,195,721 B2
(45) Date of Patent: Feb. 5, 2019

(54) HAND TOOL STEP DRIVE MECHANISM AND CRIMPING METHOD

(71) Applicant: ETABLISSEMENTS PIERRE GREHAL ET CIE SA, Baillet en France (FR)

(72) Inventor: Lionel Marcon, Parmain (FR)

(73) Assignee: ETABLISSEMENTS PIERRE GREHAL ET CIE SA, Baillet-en-France (FR)

( * ) Notice: Subject to any disclaimer, the term of this patent is extended or adjusted under 35 U.S.C. 154(b) by 188 days.

(21) Appl. No.: 15/029,735

(22) PCT Filed: Oct. 21, 2014

(86) PCT No.: PCT/IB2014/065505
§ 371 (c)(1),
(2) Date: Apr. 15, 2016

(87) PCT Pub. No.: WO2015/059635
PCT Pub. Date: Apr. 30, 2015

(65) Prior Publication Data

US 2016/0279765 A1 Sep. 29, 2016

(30) Foreign Application Priority Data

Oct. 21, 2013 (FR) ..... 13 60235

(51) Int. Cl.
*B21D 39/02* (2006.01)
*B25B 7/12* (2006.01)
(Continued)

(52) U.S. Cl.
CPC ..... *B25B 7/12* (2013.01); *B21D 39/025* (2013.01); *B21D 39/034* (2013.01); *B26D 5/10* (2013.01);
(Continued)

(58) Field of Classification Search
CPC .... B25B 7/12; B25B 7/22; B25B 7/00; B21D 39/025; B21D 39/031; B21D 39/034;
(Continued)

(56) References Cited

U.S. PATENT DOCUMENTS 2,874,666 A * 2/1959 Thor ..... B21D 39/034 29/21.1
3,261,073 A * 7/1966 Klenk ..... B21D 39/034 29/21.1
(Continued)

FOREIGN PATENT DOCUMENTS

DE 9315482 U1 * 1/1994 ..... B21D 31/02
DE 100 54 752 5/2002
(Continued)

*Primary Examiner* — Jermie Cozart
(74) *Attorney, Agent, or Firm* — Clark & Brody

(57) ABSTRACT

The present invention relates to a step drive mechanism to be attached into the hollow body of a tool, making it possible to produce a thrust movement that can be easily carried out. To this end, the mechanism includes: a rack (2) that has a first (3) and a second (4) cog having back-slanted teeth (3*a*, 4*a*) arranged on an upper (2*a*) and a lower (2*b*) edge, respectively; a front end (2*c*); a pivotable lever (5) that comprises a hollow top end (5*a*) receiving a torsion spring (8), bearing against said hollow top end (5*a*) of the lever and against a thrust pawl (7) pivoting in the hollow body (1) in front of the hollow top end (5*a*) of the lever, and has a crosspiece (7*a*) inserted between the teeth (3*a*) of the first cog (3); and a pivotable locking pawl (8) provided with a crosspiece (8*a*) inserted between the teeth (4*a*) of the second cog (4). A compression spring (9) is arranged such as to bear against the locking pawl (8) and against an abutment (2*d*) located at a rear end (2*e*) of the rack (2).

12 Claims, 4 Drawing Sheets

(51) Int. Cl.
*B21D 39/03* (2006.01)
*B26D 5/10* (2006.01)

(52) U.S. Cl.
CPC ..... *Y10T 29/49837* (2015.01); *Y10T 29/539* (2015.01); *Y10T 29/53996* (2015.01)

(58) Field of Classification Search
CPC ..... B21D 39/035; B26D 5/083; B26D 5/10; B26D 5/16; Y10T 29/49837; Y10T 29/539; Y10T 29/53996
See application file for complete search history.

(56) References Cited

U.S. PATENT DOCUMENTS

| | | | | |
|---|---|---|---|---|
| 3,714,688 | A * | 2/1973 | Olson | B21D 39/034 29/21.1 |
| 2007/0220943 | A1 * | 9/2007 | Lavalliere | B21D 39/04 72/409.01 |

FOREIGN PATENT DOCUMENTS

| | | | | |
|---|---|---|---|---|
| EP | 0 203 241 | | 12/1986 | |
| EP | 0203241 | A1 * | 12/1986 | B21D 39/034 |
| EP | 0 745 443 | | 12/1996 | |
| EP | 0 748 614 | | 12/1996 | |
| EP | 0865880 | A1 * | 9/1998 | B21D 39/034 |
| GB | 745380 | A * | 2/1956 | B21D 39/034 |
| WO | WO 2007073289 | A1 * | 6/2007 | B25B 7/10 |

* cited by examiner

HAND TOOL STEP DRIVE MECHANISM AND CRIMPING METHOD

FIELD OF THE INVENTION

The invention relates to a hand tool step drive mechanism, to a pair of crimping pliers provided with such a mechanism as well as to a crimping method which implements such a pair of crimping pliers.

BACKGROUND ART

Crimpling pliers serve for assembling two parts together by means of crimping. In particular, said parts are advantageously open metal profiles which are arranged one against the other and are used, notably in certain structures or frameworks assembling plasterboard, in the wall or the ceiling.

Conventionally, the metal profiles used are in the form of a U-shaped section.

They generally have a sheet metal thickness of between 0.5 and 1 mm, such that, during crimping, the user has to pierce between 1 and 2 mm of sheet metal with the punch.

A user may have to do several dozen crimps in a working day such that if the first crimps are easy, the following ones tend to become more and more tiring.

Apart from piercing the metal sheets, stripping (that is to say removing the punch from the crimp) is also a force generator, considering that the stripping force increases when the punch heats up, that is to say after numerous uses.

Among professionals, said forces often result in musculoskeletal problems which contribute to the arduousness of the work.

The objective of the present invention is therefore to propose a step drive mechanism which enables a drive movement that is easier to implement to be obtained, in particular in order to drive a punch into the metal sheets to be crimped.

SUMMARY OF THE INVENTION

To this end, the object of the invention is a hand tool step drive mechanism, such as a pair of crimping pliers, intended to be fixed in a hollow body which has a rear end and a front end. The mechanism is characterized in that it includes, with reference to the normal position of use and to the direction of drive:

- a rack which is intended to be mounted in the hollow body so as to slide between a starting position and an end position, and which has:
  - two longitudinal edges, upper and lower respectively,
  - a first toothing having rearwardly angled teeth which is arranged on to one of the two longitudinal edges;
  - a second toothing having rearwardly angled teeth which is arranged on the other of the two longitudinal edges;
  - a front end;
- a lever which is intended to be mounted so as to pivot in the hollow body between a maximum tightening position and an initializing position, said lever comprising a hollow upper end which receives a torsion spring which bears against said hollow upper end of the lever and bears against a so-called "drive" ratchet, which is intended to be mounted so as to pivot in the hollow body, in front of the hollow upper end of the lever, and is provided with a crossbar which engages between the teeth of the first toothing;

- a so-called "locking" ratchet which is intended to be mounted so as to pivot in the hollow body and is provided with a crossbar which engages between the teeth of the second toothing, a compression spring being arranged bearing against the locking ratchet and bearing against a stop which is situated on a rear end of the rack.

According to a particular embodiment, the locking ratchet has additionally:

- a contact surface with the drive ratchet; and
- a contact surface with the hollow upper end of the pivotable lever; said contact surfaces being arranged in order to bring about the release of the crossbar from the locking ratchet at the same time as the crossbar from the drive ratchet when the pivotable lever is pivoted into the initializing position.

Another object of the invention is a pair of crimpling pliers in order to crimp two parts together, such as metal sheets, including, with reference to the normal position of use and to the direction of drive:

- a hollow body which has a rear end and a front end;
- a fixed handle which is an integral part of the hollow body;
- a rack which is mounted in the hollow body so as to slide between a starting position and a crimping position, and which has:
  - a first toothing having rearwardly angled teeth which is arranged on an upper edge;
  - a second toothing having rearwardly angled teeth which is arranged on a lower edge;
  - a front end which is provided with a punch;
- a handle, acting as a lever, which is mounted so as to pivot in the hollow body between a maximum tightening position and a stripping position, said handle comprising a hollow upper end which receives a torsion spring which bears against said hollow upper end and bears against a so-called "drive" ratchet, which is mounted so as to pivot in the hollow body, in front of the hollow upper end of the lever, and is provided with a crossbar which engages between the teeth of the first toothing;
- a so-called "locking" ratchet which is mounted so as to pivot in the hollow body and is provided with a crossbar which engages between the teeth of the second toothing, a compression spring being arranged bearing against the locking ratchet and bearing against a stop which is situated on a rear end of the rack.

According to other embodiments:

- the front end and the rear end of the rack can each be provided with at least one guide tab, each of which are engaged in an oblong slot which is arranged at the front and at the rear of the hollow body in such a manner that the rack is slidingly mounted in the hollow body by means of dual guides;
- the front end of the hollow body can have a crimp hook which is provided with a crimp end which is intended to be positioned in support behind the parts to be crimped, the crimp end being situated at a determined spacing from the punch, which is carried by the front end of the rack in the starting position in such a manner that, in use, the punch comes into contact with a first of the two parts to be crimped, in a contact position, when the handle which is pivotably mounted is in an intermediate tightening position which is between a zero tightening position and the maximum tightening position, the zero tightening position being situated between the maximum tightening position and the stripping position;

the intermediate tightening position, with respect to the zero tightening position, can be between 20% and 80% of the maximum tightening position, in a preferred manner between 60% and 40% of the maximum tightening position and in an advantageous manner is 50% of the maximum tightening position;

a length of the oblong slots can be chosen so that the guide tabs are in abutment with a front end of the oblong slots at the end of crimping;

the locking ratchet can additionally have:

a contact surface with the drive ratchet; and a contact surface with the hollow upper end of the pivotable handle, said contact surfaces being arranged in order to bring about the release of the crossbar from the locking ratchet at the same time as the crossbar from the drive ratchet when the pivotable handle is pivoted into the stripping position.

Another object of the invention is also a crimping method for crimping two parts together, such as metal sheets, which includes:

a) supplying the two parts;

b) positioning the two parts in a crimping position;

c) supplying a pair of crimping pliers as above;

d) positioning the front end of the hollow body behind the parts with reference to the direction of drive of the rack, said rack being in a starting position;

e) step driving the rack toward the two parts by successively tightening the pivotable handle toward the fixed handle, at a tightening force which is less than a tightening force necessary for the punch to pierce the parts, until the punch is in a contact position with a first of the two parts;

f) applying a tightening force sufficient to pierce the two parts with the punch;

g) step driving the rack through the two parts as a result of successively tightening the pivotable handle toward the fixed handle, at a tightening force which is less than a tightening force necessary for the punch to pierce the parts, until the crimping of the two parts is obtained.

According to a particular embodiment, during step e), the pivotable handle is in an intermediate position between the zero tightening position and the maximum tightening position when the punch is in the contact position with a first of the two parts.

BRIEF DESCRIPTION OF THE DRAWINGS

Other characteristics of the invention will be outlined in the detailed description below, provided with reference to the accompanying drawings, in which, respectively.

DETAILED DESCRIPTION OF THE INVENTION

Figure 1:
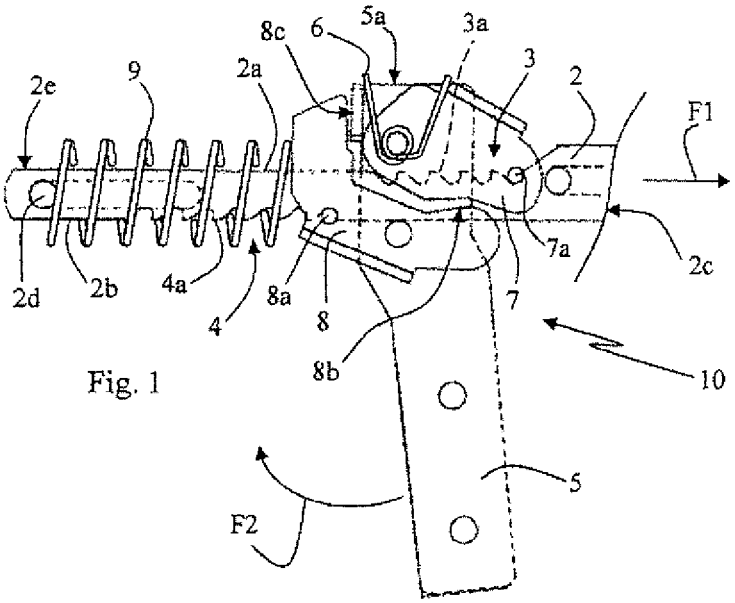
FIG. 1 shows a schematic representation of a plan view of a step drive mechanism according to the invention.

The step drive mechanism shown in FIG. 1 can be used in any type of hand tool requiring a driving force and not a pulling force. For example, it can be a pair of crimping pliers, as described below, but also a cutting tool in which the blade is driven against a stop.

The following description of the mechanism and of the crimping pliers according to the invention is provided with reference to the normal position of use (that which is shown) and to the direction of drive F1. Thus, for example, a "front" structure, and a "rear" structure respectively, signifies that said structure is situated toward the front, and toward the rear respectively, of the tool when the user holds it in the position of use. As the tool according to the invention is provided in order to generate a drive, this signifies that a rear structure of the tool is situated close to the user, whilst a front structure is situated remote from the user.

The mechanism according to the invention is intended to be mounted in a hollow body 101 (see FIG. 2) of a tool which has a rear end 101*a* and a front end 101*b*. In an advantageous manner, said hollow body is constituted by a metal sheet which is folded on itself in order to form a U. As an alternative to this, it can be a molded part.

The mechanism comprises a rack 2 which is intended to be mounted so as to slide in the hollow body between a starting position $P_i$ and an end position $P_F$.

In a general manner, the rack has:

two longitudinal edges 2*a*, 2*b*, upper and lower respectively;

a first toothing 3 having rearwardly angled teeth 3*a* which is arranged on one of the two longitudinal edges;

a second toothing 4 having rearwardly angled teeth 4*a* which is arranged on the other of the two longitudinal edges;

a front end 2*c*.

In the preferred embodiments shown and described below, the rack has:

a first toothing 3 having rearwardly angled teeth 3*a* which is arranged on the upper edge 2*a;* a second toothing 4 having rearwardly angled teeth 4*a* which is arranged on the lower edge 2*b*.

A lever 5 is intended to be mounted so as to pivot in the hollow body 101 between a maximum tightening position $P_{SM}$ and an initializing position $P_{DEV}$.

The maximum tightening position $P_{SM}$ signifies that the lever is pivoted to the maximum in order to make the rack advance by a notch, and the initialization position $P_{DEV}$ signifies that the lever is pivoted toward said position in order to reposition the rack in the starting position $P_i$.

The lever comprises a hollow upper end 5*a* which receives a torsion spring 6 which bears against said hollow upper end 5*a* of the lever and bears against a so-called "drive" ratchet 7 which is also intended to be mounted so as to pivot in the hollow body 101, in front of the hollow upper end 5*a* of the lever in such a manner that a crossbar 7*a* which is part of the ratchet engages between the teeth 3*a* of the first toothing 3.

Thus, when the lever is pivoted according to the arrow F2, toward the maximum tightening position $P_{SM}$, it pushes the ratchet 7 according to the arrow F3 (see FIG. 2) by means of the torsion spring 6. As the crossbar 7*a* is engaged by a tooth which is angled rearward, it pushes the rack in the direction of the arrow F1.

The mechanism also comprises a so-called "locking" ratchet 8 which is intended to be mounted so as to pivot in the hollow body 101 and is provided with a crossbar 8*a* which engages between the teeth 4*a* of the second toothing 4, a compression spring 9 being arranged bearing against the locking ratchet 8 and bearing against a stop 2*d* which is situated on a rear end 2*e* of the rack 2.

Thus, when the lever is pivoted according to the arrow F2, and when the rack is pushed forward (arrow F1), the crossbar 8*a* slides along a tooth 4*a* of the second toothing. As soon as the crossbar 8*a* passes the end of the tooth, the compression spring 9 forces the crossbar 8*a* to stop behind the tooth such that the rack is locked in that position.

A function of the torsion spring is to restore the pivotable lever from the maximum tightening position $P_M$ toward a zero tightening position $P_{S0}$, or rest position, situated between the maximum tightening position $P_M$ and the initialization position $P_{DEV}$. The rack is locked when the lever is being returned to said zero tightening position.

The rack is advanced, notch by notch, as a result of successively tightening the pivot.

In the end position $P_F$ (for example when the crimp is obtained), the rack has to be freed.

To do this, the user pivots the lever in the direction of the arrow F6 (see FIG. 4) toward the initialization position.

The locking ratchet 8 additionally has:

a contact surface 8*b* with the drive ratchet 7; and a contact surface 8*c* with the hollow upper end 5*a* of the pivotable lever 5.

Said contact surfaces 8*b*, 8*c* are arranged in order to bring about the release of the crossbar 8*a* from the locking ratchet 8 at the same time as the crossbar 7*a* from the drive ratchet 7 when the pivotable lever 5 is pivoted into the initializing position $P_{DEV}$ (arrow F6). In fact, when the lever is pivoted in the direction of the arrow F6, the hollow upper end 5*a* of the pivotable lever 5 moves into contact with the surface 8*c* and makes the locking ratchet 8 pivot in the direction of the arrow F4. The contact surface 8*b* of the locking ratchet therefore moves into contact with the drive ratchet 7 and makes it pivot in the direction of the arrow F5.

The crossbars of the ratchets are therefore forced to move out of the toothings, thus freeing the rack. The compression spring 9 is therefore released and repositions the rack in the starting position.

Thus, apart from its function of restraining the cross bar 8*a*, the compression spring also has a dual restoring function:

a first function for restoring the rack from the end position $P_F$ (for example once the crimp is obtained) toward its starting position $P_i$; and a second function for restoring the lever from the initialization position $P_{DEV}$ (for example the stripping control position for a pair of crimping pliers) toward the zero tightening position $P_{S0}$, or the rest position.

Figure 2:
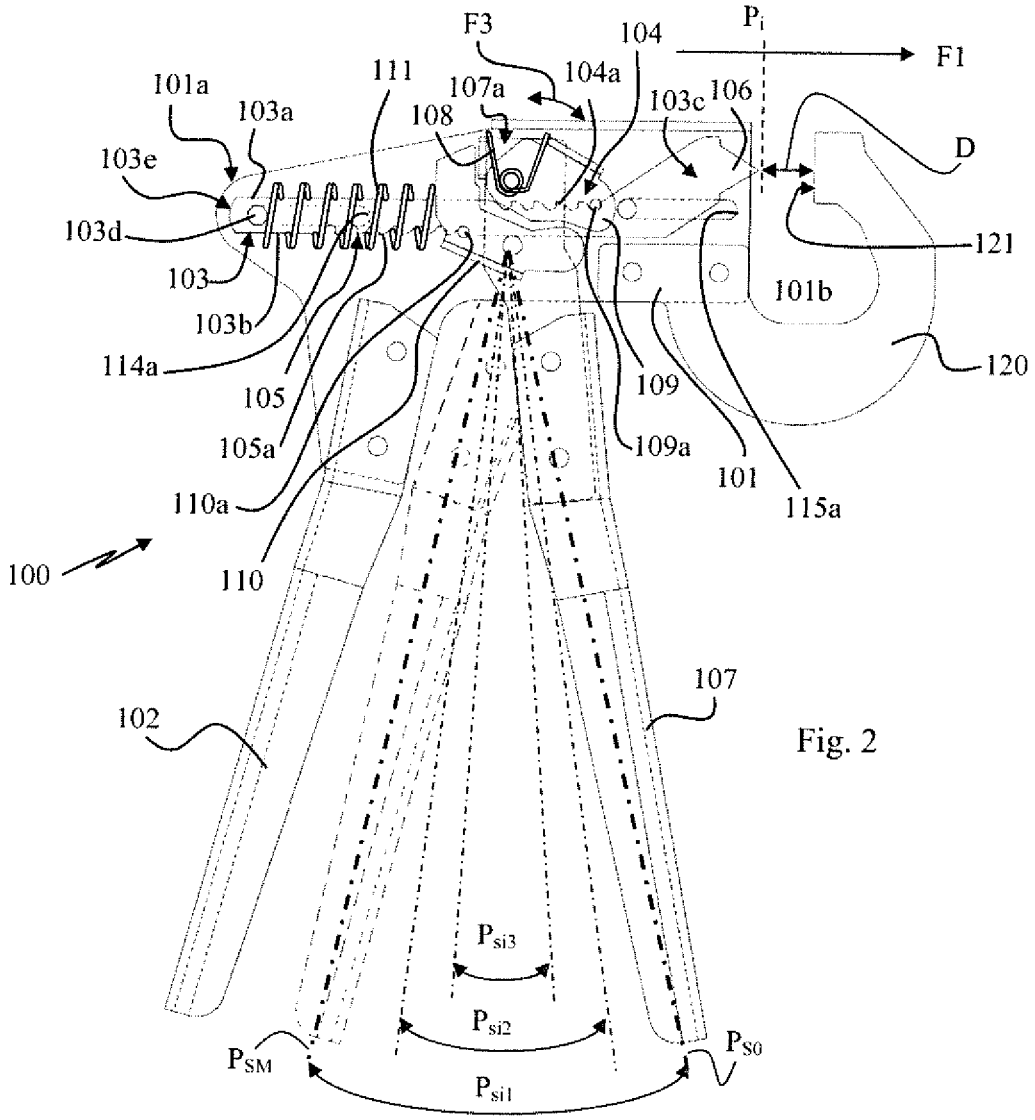
FIG. 2 shows a schematic representation of a plan view of a pair of crimping pliers provided with a step drive mechanism according to the invention, in the starting position and in the zero tightening position.
Figure 3:
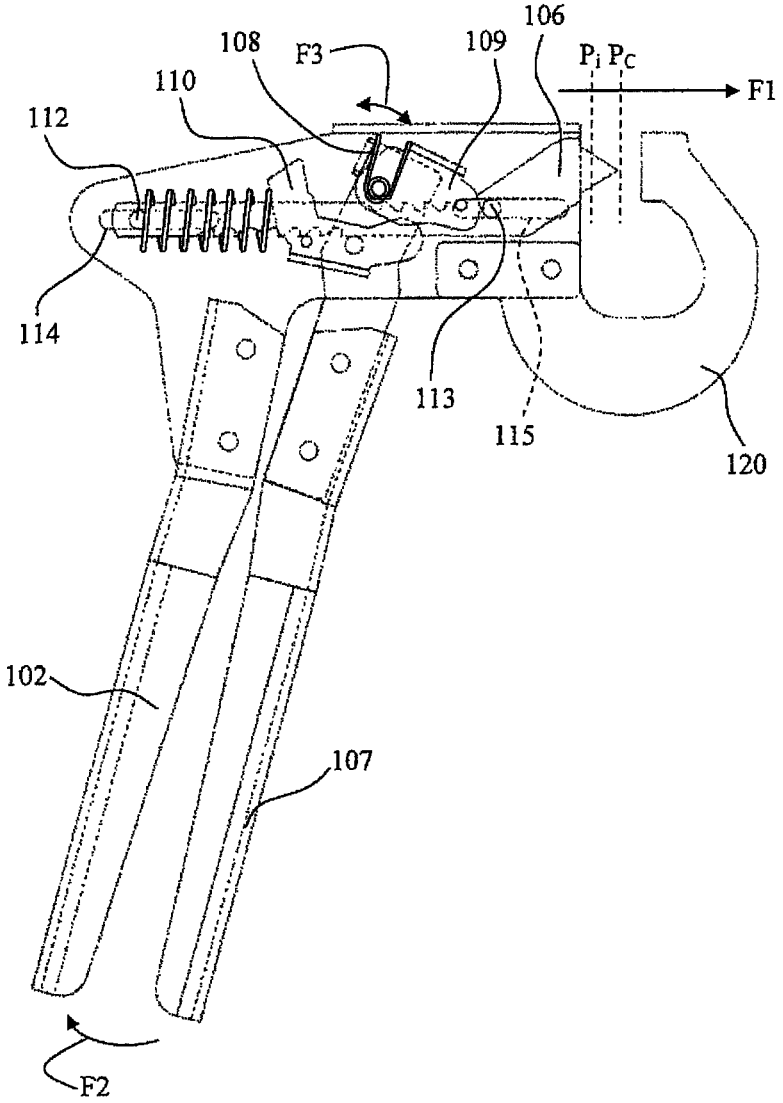
FIG. 3 shows a schematic representation of a plan view of a pair of crimping pliers provided with a step drive mechanism according to the invention, during crimping and in a maximum tightening position.
Figure 4:
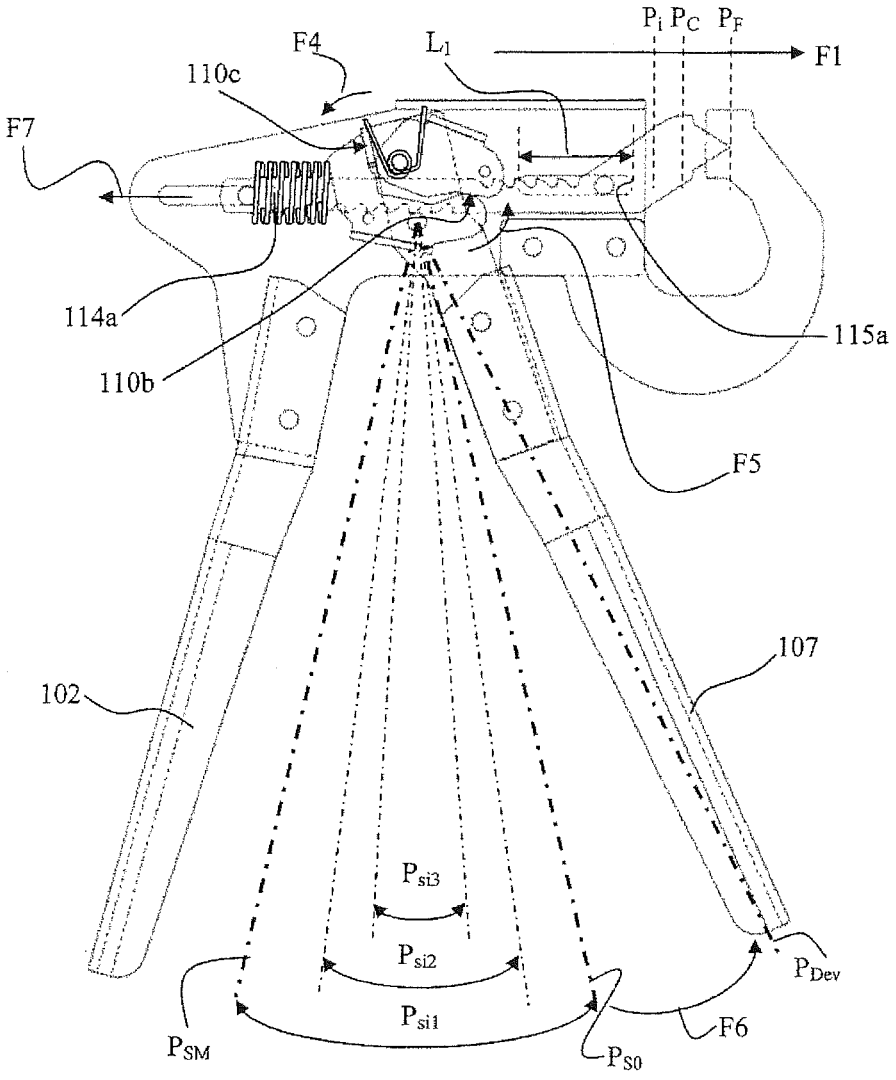
FIG. 4 shows a schematic representation of a plan view of a pair of crimping pliers provided with a step drive mechanism according to the invention, in the stripping position.

FIGS. 2 to 4 show a pair of crimping pliers 100 provided with a mechanism according to the invention.

These pliers include:

a hollow body 101 which has a rear end 101*a* and a front end 101*b;* a fixed handle 102 which is an integral part of the hollow body 101;

a rack 103 which is mounted in the hollow body 101 so as to slide between a starting position $P_i$ and a crimping position $P_F$ (see FIG. 4).

The rack has:

a first toothing 104 having rearwardly angled teeth 104*a* which is arranged on an upper edge 103*a;* a second toothing 105 having rearwardly angled teeth 105*a* which is arranged on a lower edge 103*b;* a front end 103*c* which is provided with a punch 106.

A handle 107, acting as a lever, is mounted so as to pivot in the hollow body 101 between a maximum tightening position $P_{SM}$ (shown by the dotted line in FIG. 2) and a stripping position $P_{DEV}$ (shown in FIG. 4).

The pivotable handle 107 is mounted in front of the fixed handle 102, that is to say that the handle 107 is situated between the fixed handle and the front end 101*b* of the hollow body. In other words, in use, a pivoting of the pivotable handle 107 toward the maximum tightening position $P_{SM}$ causes the punch to advance toward the front end 101*b* of the hollow body 101.

Said arrangement allows the user to apply optimum force since his fingers, moving, are in contact with the pivotable handle 107, whilst his palm, static, receives the fixed handle 102.

The movable handle 107 comprises a hollow upper end 107*a* which receives a torsion spring 108 which bears against said hollow upper end 107*a* and bears against a so-called "drive" ratchet 109 which is mounted so as to pivot in the hollow body 101, in front of the hollow upper end 107*a*, and is provided with a crossbar 109*a* which engages between the teeth 104*a* of the first toothing 104.

A so-called "locking" ratchet 110 is also mounted so as to pivot in the hollow body 101 and is provided with a crossbar 110*a* which engages between the teeth 105*a* of the second toothing 105. A compression spring 111 is arranged bearing against the locking ratchet 110 and bearing against a stop 103*d* which is situated on a rear end 103*e* of the rack 103.

The front end 103*c* and the rear end 103*e* of the rack 103 are each provided with at least one guide tab 112-113, each of which is engaged in an oblong slot 114-115 which is arranged at the front and at the rear of the hollow body 101 in such a manner that the rack 103 is slidingly mounted in the hollow body by means of dual guides. In an advantageous manner, the tabs are each connected to two oblong slots which are situated on both sides of the rack, in the hollow body. This improves the quality of the drive and therefore of the crimp as the punch is guided on each side, at the front and at the rear.

Like the conventional crimping pliers, the front end 101*b* of the hollow body 101 has a crimping hook 120 which is provided with a crimping end 121 which is intended to be positioned in support behind the metal sheets to be crimped.

According to an advantageous embodiment of the invention, the crimp end 121 is situated at a determined spacing D from the front end of the punch 106, which is carried by the front end 103*a* of the rack 103 in the starting position $P_i$ in such a manner that, in use, the punch comes into contact with a first of the two metal sheets, in a contact position $P_C$, when the handle which is pivotably mounted is in an intermediate tightening position $P_{SI1}$, $P_{SI2}$, $P_{SI3}$ which is between the zero tightening position $P_{S0}$ and the maximum tightening position $P_{SM}$.

Said characteristic of the invention allows for much simpler crimping than if the punch were to move into contact with the metal sheet at the end of the travel or at the start of the travel of the pivotable handle.

In effect, the most critical stage of the crimping is the piercing of the metal sheets. Before said piercing, the user only applies a little force in order to bring the punch into contact with the metal sheet. After the piercing, the resistance to the crimping is generated solely by the friction of the punch against the metal sheets. The force necessary during said stage is greater than for bringing the punch into contact with the metal sheets, but is less than the force necessary for piercing.

Even if the use of a step mechanism according to the invention greatly facilitates the crimping, the Applicant has found that in choosing a spacing D such that contact between the punch and the metal sheet is made when the pivotable handle is in an intermediate position between the zero tightening position $P_{S0}$ and the maximum tightening position $P_{SM}$, the piercing of the metal sheets is facilitated.

Thus, the invention takes advantage of the fact that the tightening force of the user is maximal when his hand is neither in the maximum extension position (the position of the pivotable handle therefore being the zero tightening position $P_{S0}$), nor in the maximum tightening position (the position of the pivotable handle therefore being the maximum tightening position $P_{SM}$).

In a preferred manner, the intermediate tightening position $P_{SI1}$, $P_{SI2}$, $P_{SI3}$, with respect to the zero tightening position $P_{S0}$, is between 20% and 80% of the maximum tightening position, in a preferred manner between 40% and 60% of the maximum tightening position and in an advantageous manner is 50% of the maximum tightening position.

An intermediate tightening position at X % of the maximum tightening position signifies that the pivotable handle is at an angular spacing from the maximum tightening position which is equal to X % of the angular spacing which separates the maximum tightening position from the zero tightening position.

Tiredness due to repeated crimping is therefore reduced. It follows that users with less developed physical strength than professionals are easily able to realize rail crimping.

According to another aspect of the invention, the length L1 of the oblong slots 114-115 is chosen so that the guide tabs 112-113 are in abutment with a front end 114*a*-115*a* of the oblong slots 114-115 at the end of crimping.

This will ensure that the punch will not be able to continue its travel, at the risk of destroying the crimp. It also allows the user to carry out consecutive crimps with the pivotable handle until the guide tabs 112-113 abut against the front end 114*a*-115*a* of the oblong slots without fear of damaging the crimp.

When the crimping is completed, the user only has to pivot the pivotable handle toward the stripping position (see FIG. 3).

To this end, the locking ratchet 110 additionally has:

a contact surface 110*b* with the drive ratchet 109; and a contact surface 110*c* with the hollow upper end 107*a* of the pivotable handle 107.

The contact surfaces 110*b*, 110*c* are arranged in order to bring about the release of the crossbar 110*a* from the locking ratchet 110 at the same time as the crossbar 109*a* from the drive ratchet 109 when the pivotable handle is pivoted into the stripping position.

In said position, the compression spring 9 is released and automatically repositions the rack in the starting position $P_i$.

The user does therefore not have to supply any force during stripping, contrary to conventional pliers which require the user to move the handles apart in order to remove the punch from the crimp.

The compression spring 9 is therefore chosen in order to provide sufficient rigidity in order to remove the punch from the crimp (stripping).

The torsion spring 6, 108 is chosen in order to provide sufficient rigidity in order, after a crimp, to allow for the return of the pivotable handle toward the zero tightening position $P_{S0}$. As an alternative to this, if an interior volume of the hollow body is not sufficient to allow for the use of a sufficiently rigid torsion spring 6, 108, a third spring may be added between the pivotable handle and the fixed handle in order to restore the mobile handle toward the zero tightening position $P_{S0}$.

Using the crimpling pliers according to the invention, the crimping method includes:

a) supplying two metal sheets which have to be crimped together;

b) positioning the two metal sheets in a crimping position;

c) supplying crimping pliers according to the invention;

d) positioning the front end of the hollow body behind the metal sheets with reference to the direction of drive of the rack, said rack being in a starting position $P_i$;

e) step driving the rack toward the two metal sheets by successively tightening the pivotable handle toward the fixed handle, at a tightening force which is less than a tightening force necessary for the punch to pierce the parts, until the punch is in a contact position $P_C$ with a first of the two metal sheets;

f) applying a tightening force sufficient to pierce the two metal sheets with the punch;

g) step driving the rack through the two metal sheets as a result of successively tightening the pivotable handle toward the fixed handle, at a tightening force which is less than a tightening force necessary for the punch to pierce the parts, until the crimping of the two metal sheets is obtained.

Subsequently, the method includes a stripping stage which consists in pivoting the pivotable handle toward the stripping position so as to free the crossbars of the ratchets from the toothings of the rack, thus releasing the compression spring which automatically repositions the rack in the starting position $P_i$.

In a preferred manner, during stage e), the pivotable handle is in an intermediate position $P_{SI1}$, $P_{SI2}$, $P_{SI3}$ between the zero tightening position $P_{S0}$ and the maximum tightening position $P_{SM}$ when the punch is in the contact position $P_C$ with a first of the two metal sheets.

The invention claimed is:

1. A hand tool step drive mechanism (10), which mechanism is intended to be fixed in a hollow body (1) which has a rear end (1*a*) and a front end (1*b*), characterized in that said mechanism includes, with reference to the normal position of use and to the direction of drive (F1):

a rack (2) which is intended to be mounted in the hollow body (1) so as to slide between a starting position ($P_i$) and an end position ($P_F$) and which has:

two longitudinal edges (2*a*, 2*b*), upper (2*a*) and lower (2*b*) respectively, a first toothing (3) having rearwardly angled teeth (3*a*) which is arranged on one of the two longitudinal edges (2*a*, 2*b*);

a second toothing (4) having rearwardly angled teeth (4*a*) which is arranged on the other of the two longitudinal edges (2*b*, 2*a*);

a front end (2*c*);

a lever (5) which is intended to be mounted so as to pivot in the hollow body (1) between a maximum tightening position ($P_{SM}$) and an initializing position ($P_{DEV}$), said lever comprising a hollow upper end (5*a*) which receives a torsion spring (6) which bears against said hollow upper end (5*a*) of the lever and bears against a drive ratchet (7), which is intended to be mounted so as to pivot in the hollow body (1), in front of the hollow upper end (5*a*) of the lever, and is provided with a crossbar (7*a*) which engages between the teeth (3*a*) of the first toothing (3);

a locking ratchet (8) which is intended to be mounted so as to pivot in the hollow body (1) and is provided with a crossbar (8*a*) which engages between the teeth (4*a*) of the second toothing (4), a compression spring (9) being arranged bearing against the locking ratchet (8) and bearing against a stop (2*d*) which is situated on a rear end (2*e*) of the rack (2).

2. The step drive mechanism as claimed in claim 1, in which the locking ratchet (8) has additionally:

a contact surface (8*b*) with the drive ratchet (7); and a contact surface (8*c*) with the hollow upper end (5*a*) of the pivoting lever (5);

said contact surfaces (8*b*, 8*c*) being arranged in order to bring about the release of the crossbar (8*a*) from the locking ratchet (8) at the same time as the crossbar (7*a*) from the drive ratchet (7) when the pivotable lever (5) is pivoted into the initializing position ($P_{DEV}$).

3. A pair of crimping pliers (100) in order to crimp two parts together, characterized in that said pliers include, with reference to the normal position of use and to the direction of drive:

a hollow body (101) which has a rear end (101*a*) and a front end (101*b*);

a fixed handle (102) which is an integral part of the hollow body (101);

a rack (103) which is mounted in the hollow body (101) so as to slide between a starting position ($P_r$) and a crimping position ($P_F$) and which has:

a first toothing (104) having rearwardly angled teeth (104*a*) which is arranged on an upper edge (103*a*);

a second toothing (105) having rearwardly angled teeth (105*a*) which is arranged on a lower edge (103*b*);

a front end (103*c*) which is provided with a punch (106);

a handle (107), acting as a lever, which is mounted so as to pivot in the hollow body (101) between a maximum tightening position ($P_{SM}$) and a stripping position ($P_{DEV}$), said handle (107) comprising a hollow upper end (107*a*) which receives a torsion spring (108) which bears against said hollow upper end (107*a*) and bears against a drive ratchet (109), which is mounted so as to pivot in the hollow body (101), in front of the hollow upper end (107*a*), and is provided with a crossbar (109*a*) which engages between the teeth (104*a*) of the first toothing (104);

a locking ratchet (110) which is mounted so as to pivot in the hollow body (101) and is provided with a crossbar (110*a*) which engages between the teeth (105*a*) of the second toothing (105), a compression spring (111) being arranged bearing against the locking ratchet (110) and bearing against a stop (103*d*) which is situated on a rear end (103*e*) of the rack (103).

4. The crimping pliers as claimed in claim 3, in which the front end (103*c*) and the rear end (103*e*) of the rack (103) are each provided with at least one guide tab (112-113), each of which is engaged in an oblong slot (114-115) which is arranged at the front and at the rear of the hollow body (101) in such a manner that the rack (103) is slidingly mounted in the hollow body by means of dual guides.

5. The crimping pliers as claimed in claim 3, in which the front end (101*b*) of the hollow body (101) has a crimp hook (120) which is provided with a crimp end (121) which is intended to be positioned in support behind the parts to be crimped, the crimp end (121) being situated at a determined spacing (D) from the punch (106), which is carried by the front end (103*a*) of the rack (103) in the starting position ($P_i$) in such a manner that, in use, the punch comes into contact with a first of the two parts to be crimped, in a contact position ($P_C$), when the handle which is pivotably mounted is in an intermediate tightening position ($P_{SI1}$, $P_{SI2}$, $P_{SI3}$) which is between a zero tightening position ($P_{S0}$) and the maximum tightening position ($P_{SM}$), the zero tightening position ($P_{S0}$) being situated between the maximum tightening position ($P_{SM}$) and the stripping position ($P_{DEV}$).

6. The crimping pliers as claimed in claim 5, in which the intermediate tightening position ($P_{SI1}$, $P_{SI2}$, $P_{SI3}$), with respect to the zero tightening position ($P_{S0}$), is between 20% and 80% of the maximum tightening position.

7. The crimping pliers as claimed in claim 6, in which the intermediate tightening position ($P_{SI1}$, $P_{SI2}$, $P_{SI3}$), with respect to the zero tightening position ($P_{S0}$), is between 40% and 60% of the maximum tightening position.

8. The crimping pliers as claimed in claim 7, in which the intermediate tightening position ($P_{SI1}$, $P_{SI2}$, $P_{SI3}$), with respect to the zero tightening position ($P_{S0}$), is 50% of the maximum tightening position.

9. The crimping pliers as claimed in claim 3, in which a length (L1) of the oblong slots (114-115) is chosen so that guide tabs (112-113) are in abutment with a front end (114*a*-115*a*) of the oblong slots (114-115) at the end of crimping.

10. The crimping pliers as claimed in claim 3, in which the locking ratchet (110) additionally has:

a contact surface (110*b*) with the drive ratchet (109); and a contact surface (110*c*) with the hollow upper end (107*a*) of the pivotable handle (107);

said contact surfaces (110*b*, 110*c*) being arranged in order to bring about the release of the crossbar (110*a*) from the locking ratchet (110) at the same time as the crossbar (109*a*) from the drive ratchet (109) when the pivoting handle is pivoted into the stripping position.

11. A crimping method for crimping two parts together which includes:

a) supplying the two parts;

b) positioning the two parts in a crimping position;

c) supplying a pair of crimping pliers, the pair of crimping pliers further comprising, with reference to the normal position of use and to the direction of drive:

a hollow body (101) which has a rear end (101*a*) and a front end (101*b*);

a fixed handle (102) which is an integral part of the hollow body (101);

a rack (103) which is mounted in the hollow body (101) so as to slide between a starting position ($P_i$) and a crimping position ($P_F$) and which has:

a first toothing (104) having rearwardly angled teeth (104*a*) which is arranged on an upper edge (103*a*);

a second toothing (105) having rearwardly angled teeth (105*a*) which is arranged on a lower edge (103*b*);

a front end (103*c*) which is provided with a punch (106);

a handle (107), acting as a lever, which is mounted so as to pivot in the hollow body (101) between a maximum tightening position ($P_{SM}$) and a stripping position ($P_{DEV}$) said handle (107) comprising a hollow upper end (107*a*) which receives a torsion spring (108) which bears against said hollow upper end (107*a*) and bears against a drive ratchet (109), which is mounted so as to pivot in the hollow body (101), in front of the hollow upper end (107*a*), and is provided with a crossbar (109*a*) which engages between the teeth (104*a*) of the first toothing (104);

a locking ratchet (110) which is mounted so as to pivot in the hollow body (101) and is provided with a crossbar (110*a*) which engages between the teeth (105*a*) of the second toothing (105), a compression spring (111) being arranged bearing against the locking ratchet (110) and bearing against a stop (103*d*) which is situated on a rear end (103*e*) of the rack (103);

d) positioning the front end of the hollow body behind the parts with reference to the direction of drive of the rack, said rack being in a starting position ($P_i$);

e) step driving the rack toward the two parts by successively tightening the handle toward the fixed handle, at a tightening force which is less than a tightening force necessary for the punch to pierce the parts, until the punch is in a contact position ($P_C$) with a first of the two parts;

f) applying a tightening force sufficient to pierce the two parts with the punch;

g) step driving the rack through the two parts as a result of successively tightening the pivotable handle toward the fixed handle, at a tightening force which is less than a tightening force necessary for the punch to pierce the parts, until the crimping of the two parts is obtained.

12. The crimping method as claimed in claim 11, wherein:

the front end (103*c*) and the rear end (103*e*) of the rack (103) of the pair of crimping pliers (100) are each provided with at least one guide tab (112-113), each of which is engaged in an oblong slot (114-115) which is arranged at the front and at the rear of the hollow body (101) in such a manner that the rack (103) is slidingly mounted in the hollow body by dual guides and the front end (101*b*) of the hollow body (101) of the pair of crimping pliers (100) has a crimp hook (120) which is provided with a crimp end (121) which is intended to be positioned in support behind the parts to be crimped, the crimp end (121) being situated at a determined spacing (D) from the punch (106), which is carried by the front end (103*a*) of the rack (103) in the starting position ($P_i$) in such a manner that, in use, the punch comes into contact with a first of the two parts to be crimped, in a contact position ($P_C$), when the handle which is pivotably mounted is in an intermediate tightening position ($P_{SI1}$, $P_{SI2}$, $P_{SI3}$) which is between a zero tightening position ($P_{S0}$) and the maximum tightening position ($P_{SM}$), the zero tightening position ($P_{S0}$) being situated between the maximum tightening position ($P_{SM}$) and the stripping position ($P_{DEV}$); or the front end (101*b*) of the hollow body (101) has a crimp hook (120) which is provided with a crimp end (121) which is intended to be positioned in support behind the parts to be crimped, the crimp end (121) being situated at a determined spacing (ID) from the punch (106), which is carried by the front end (103*a*) of the rack (103) in the starting position ($P_i$) in such a manner that, in use, the punch comes into contact with a first of the two parts to be crimped, in a contact position ($P_C$), when the handle which is pivotably mounted is in an intermediate tightening position ($P_{SI1}$, $P_{SI2}$, $P_{SI3}$) which is between a zero tightening position ($P_{S0}$) and the maximum tightening position ($P_{SM}$), the zero tightening position ($P_{S0}$) being situated between the maximum tightening position ($P_{SM}$) and the stripping position ($P_{DEV}$);

in which method, during step e), the pivotable handle is in the intermediate tightening position ($P_{SI1}$, $P_{SI2}$, $P_{SI3}$) between the zero tightening position ($P_{S0}$) and the maximum tightening position ($P_{SM}$) when the punch is in the contact position ($P_C$) with a first of the two parts.

* * * * *